US012760964B2

(12) United States Patent
Dias et al.

(10) Patent No.: US 12,760,964 B2
(45) Date of Patent: Oct. 13, 2026

(54) PROCESS AND APPARATUS FOR THE RECOVERY OF BOIL-OFF GAS FROM THE LIQUEFACTION OF HYDROGEN

(71) Applicant: L'Air Liquide, Societe Anonyme pour l'Etude et l'Exploitation des Procedes Georges Claude, Paris (FR)

(72) Inventors: Florence Dias, Champigny sur Marne (FR); Oriane Farges, Houston, TX (US); Ludovic Granados, Champigny sur Marne (FR); Baptiste Pages, Champigny sur Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 235 days.

(21) Appl. No.: 18/694,739

(22) PCT Filed: Sep. 23, 2022

(86) PCT No.: PCT/EP2022/076501
§ 371 (c)(1),
(2) Date: Mar. 22, 2024

(87) PCT Pub. No.: WO2023/046889
PCT Pub. Date: Mar. 30, 2023

(65) Prior Publication Data

US 2024/0401876 A1 Dec. 5, 2024

Related U.S. Application Data

(60) Provisional application No. 63/248,185, filed on Sep. 24, 2021.

(30) Foreign Application Priority Data

Dec. 24, 2021 (EP) ..... 21217744

(51) Int. Cl.
*F25J 1/00* (2006.01)
*F25J 1/02* (2006.01)

(52) U.S. Cl.
CPC ..... *F25J 1/001* (2013.01); *F25J 1/0245* (2013.01); *F25J 1/0269* (2013.01); *F25J 1/0275* (2013.01);
(Continued)

(58) Field of Classification Search
CPC .. F25J 1/001; F25J 1/0032; F25J 1/004; F25J 1/067; F25J 1/0067; F25J 1/02;
(Continued)

(56) References Cited

U.S. PATENT DOCUMENTS 7,559,213 B2 * 7/2009 Allam ..... F25J 1/0224 62/607
2013/0291585 A1 11/2013 Bernhardt et al.
(Continued)

FOREIGN PATENT DOCUMENTS

WO WO 2005/095877 10/2005

OTHER PUBLICATIONS

International Search Report and Written Opinion for PCT/EP2022/076501, mailed Jan. 10, 2023.
(Continued)

*Primary Examiner* — Frantz F Jules
*Assistant Examiner* — Devon Moore
(74) *Attorney, Agent, or Firm* — Justin K. Murray

(57) ABSTRACT

A hydrogen boil-off gas recovery method, comprises liquefying hydrogen by cooling a hydrogen feed stream in a first cryogenic cold box, further cooling the hydrogen in a second cryogenic cold box, liquefying the hydrogen in the second cryogenic cold box or downstream thereof, providing liquefied hydrogen a loading bay containing at least one hydrogen transport truck, sending boil-off gas from at least
(Continued)

one hydrogen transport truck in the loading bay to which liquefied hydrogen has been provided to an indirect heat exchanger outside the first and second cryogenic cold boxes in order to warm the boil-off gas and mixing at least part of the warmed boil-off gas with the hydrogen feed stream upstream of the first cryogenic cold box or with hydrogen in a hydrogen refrigeration cycle used to provide refrigeration for the second cryogenic cold box as a function of the pressure of the boil-off gas.

15 Claims, 6 Drawing Sheets

(52) U.S. Cl.
CPC ..... *F25J 2210/90* (2013.01); *F25J 2230/24* (2013.01); *F25J 2245/90* (2013.01); *F25J 2280/02* (2013.01)

(58) Field of Classification Search
CPC F25J 1/0245; F25J 1/0249; F25J 1/025; F25J 1/0254; F25J 1/0259; F25J 1/0269; F25J 1/027; F25J 1/0271; F25J 2210/90; F25J 2215/10; F25J 2230/24; F25J 2245/90; F25J 2280/02; F17C 2265/03; F17C 2265/032; F17C 2265/033; F17C 2265/034; F17C 2265/036; F17C 2265/031; Y02E 60/32; Y02E 60/36; Y10S 62/931
USPC ..... 62/607, 931
See application file for complete search history.

(56) References Cited

U.S. PATENT DOCUMENTS

| | | | | |
|---|---|---|---|---|
| 2016/0356545 | A1* | 12/2016 | Chen | F25J 1/0242 |
| 2020/0141640 | A1* | 5/2020 | Turney | F25J 3/0655 |
| 2020/0149684 | A1* | 5/2020 | Bernhardt | F25J 1/001 |

OTHER PUBLICATIONS

Bracha, et al., "Large-scale hydrogen liquefaction in Germany," International Journal of Hydrogen Energy, vol. 19, No. 1, Jan. 1, 1994, pp. 53-59.
Fauve, et al., "ras Laffan helium recovery unit 2," AIP Conference Proceedings, Jan. 1, 2012, pp. 102-109.
EP Search Report for EP 21217744, mailed Jun. 1, 2022.

* cited by examiner

PROCESS AND APPARATUS FOR THE RECOVERY OF BOIL-OFF GAS FROM THE LIQUEFACTION OF HYDROGEN

CROSS REFERENCE TO RELATED APPLICATIONS

This application is a § 371 of International PCT Application PCT/EP2022/076501, filed Sep. 23, 2022, which claims the benefit of: EP21217744.8, filed Dec. 24, 2021, U.S. Ser. No. 17/743,839, filed May 13, 2022, and U.S. Provisional Application 63/248,185, filed Sep. 24, 2021, all of which are herein incorporated by reference in their entireties.

FIELD OF THE INVENTION

The present invention relates to a process and an apparatus for the recovery of boil-off gas from liquefaction of hydrogen. Liquefied hydrogen is generally transferred through a loading bay to supply one or more hydrogen transport trucks for the transportation of liquid hydrogen.

BACKGROUND OF THE INVENTION

The hydrogen transport truck filling duration (or Boil Off Gas (BOG) recovery capacity is today limited by the flexibility of the overall hydrogen liquefaction system (including the hydrogen production system) that requires the speeds of hydrogen transport truck depressurization and filling (or the amount of recoverable BOG) have to be limited, because the flow of BOG sent back to any BOG recovery system needs to match the ramp-up and ramp-down speeds of the complete system in order to maximise the recovery rate.

It is known from US2013/291585 to recycle BOG in a helium liquefier, the point to which the BOG is recycled being chosen purely as a function of the temperature and purity of the BOG.

It has been found more reliable to base the decision on whether to recycle the BOG of a hydrogen liquefier either to the feed stream or to the hydrogen refrigeration cycle, based on measurements of the pressure of the BOG. In particular, liquid stratification phenomena in the truck can mean that there is not a direct relation between the temperature and pressure of the BOG from the truck.

SUMMARY OF THE INVENTION

According to certain embodiments of the invention, the recovery of the BOG can be maximized by using those H2 molecules in any one of three different ways:

- Sending the boil-off to the liquefier(s) (depending on the global plant configuration several liquefier trains can be implemented), after heating the boil-off, for compression and re-liquefaction.
- Sending the boil-off upstream of the liquefier(s), specifically at compression trains inlet.
- Valorizing cold BOG directly in the liquefier to benefit from its frigorific power.

For such a configuration, separating the BOG depending on its pressure level and designing the compression trains capacities in consistency with the hydrogen transport truck operations is the key. The process control philosophy of the whole system is based on the adaptability of H2 feedstock load "following" the BOG generation.

In certain embodiments, the invention allows the duration of the hydrogen transport truck filling sequence to be reduced (or the volume of recovered BOG to be maximized) by controlling the feed flow rate (at the inlet of the hydrogen liquefaction system) with the BOG flow rate (by turning down the production capacity of hydrogen generation unit (or Feed flow rate) simultaneously with the recovery of BOG).

According to an object of the invention, there is provided a hydrogen boil-off gas recovery method, comprising liquefying hydrogen by cooling a hydrogen feed stream at a first pressure in a first cryogenic cold box, further cooling the hydrogen in a second cryogenic cold box, using the hydrogen refrigeration cycle to refrigerate the second cryogenic cold box, liquefying the hydrogen in the second cryogenic cold box or downstream thereof, providing liquefied hydrogen to a storage or a loading bay containing at least one hydrogen transport truck, sending boil-off gas from at least one hydrogen transport truck in the loading bay to which liquefied hydrogen has been provided to an indirect heat exchanger outside the first and second cryogenic cold boxes in order to warm the boil-off gas, measuring the pressure of the boil-off gas and if the boil-off gas stream from at least one hydrogen transport truck is below a previously determined pressure, at least part of the boil off gas stream is warmed in a first heater and mixed with a hydrogen refrigeration cycle stream and if the boil-off gas stream from at least one hydrogen transport truck is above a previously determined pressure, at least part of the boil off gas stream from at least one hydrogen transport truck is warmed in the first heater or in a second heater and mixed with a hydrogen feed stream upstream of the first cryogenic cold box.

According to further optional features:

- if the boil-off gas stream from at least one hydrogen transport truck is above a previously determined pressure, at least part of the boil off gas stream from at least one hydrogen transport truck is warmed in a second heater and mixed with a hydrogen feed stream upstream of the first cryogenic cold box, regardless of the temperature of the boil-off gas stream;
- the at least part of the warmed boil-off gas is compressed in a dedicated compressor before being mixed with the hydrogen feed stream;
- at least part of the warmed boil-off gas is compressed to the first pressure after being mixed with the hydrogen feed stream;
- the hydrogen feed stream is generated by a hydrogen generation unit and sent to the first cryogenic cold box in a first amount if warmed boil-off gas is not mixed with the hydrogen feed stream and if warmed boil-off gas is mixed with the hydrogen feed stream, the amount of hydrogen feed stream sent from the hydrogen generation unit to the first cryogenic cold box is reduced to a second amount, smaller than the first amount;
- the previously determined pressure is between 1.5 and 3 bars, preferably equal to 2 bars;
- the boil-off gas stream is analysed to detect the value of one of its components and if its hydrogen content is below a predetermined value and/or if an impurity content is above a predetermined value, the boil-off gas is not sent to the hydrogen feed stream or the hydrogen refrigeration cycle;
- if the boil-off gas stream from at least one hydrogen transport truck is below a previously determined pressure and below a previously determined temperature, at least part of the boil off gas stream is not warmed in a first heater but is mixed with a hydrogen refrigeration cycle stream;

the previously determined temperature is between −180° C. and −210° C., preferably equal to −200° C.;

if the boil-off gas stream from at least one hydrogen transport truck is below the previously determined pressure but above the previously determined temperature, the boil off stream is heated in the first heater and returned to the hydrogen refrigeration cycle;

if the boil-off gas stream from at least one hydrogen transport truck is below the previously determined pressure and below the previously determined temperature, the boil off stream is not heated in the first or second heater and is heated in a heat exchanger of the first and/or second cryogenic cold box (to cool the hydrogen feed stream to be liquefied; and/or the previously determined pressure has a value chosen between 2 and 10 bars, for example 2 bars.

According to another aspect of the invention, there is provided a hydrogen liquefier and boil-off gas recovery apparatus, comprising a liquefier for liquefying hydrogen comprising a first cryogenic cold box for cooling a hydrogen feed stream at a first pressure and a second cryogenic cold box for further cooling the hydrogen so as to liquefy the hydrogen in the second cryogenic cold box or downstream thereof, a loading bay containing at least one hydrogen transport truck, means for providing liquefied hydrogen to a storage or a loading bay containing at least one hydrogen transport truck, a hydrogen refrigeration cycle used to provide refrigeration for the second cryogenic cold box, means for detecting the pressure of a boil-off gas stream from at least one hydrogen transport truck, first and second heaters outside the first and second cryogenic cold boxes, means for sending the boil-off gas stream from at least one hydrogen transport truck to the first heater if, preferably only if, the detected pressure is below a previously determined pressure, means for sending the boil-off stream warmed in the first heater to be mixed with the hydrogen refrigeration cycle and means for sending the boil-off gas stream from at least one hydrogen transport truck to the second heater if, preferably only if, the detected pressure is above a previously determined pressure and means for sending the boil-off stream warmed In the first heater to be mixed with a hydrogen feed stream upstream of the first cryogenic cold box.

Preferably the liquefier comprises means for detecting the temperature of a boil-off gas stream from at least one hydrogen transport truck, means for sending the boil-off gas stream from at least one hydrogen transport truck to the hydrogen refrigeration cycle without being heated if the detected temperature is below a previously determined temperature and if the detected pressure is also below a previously determined pressure.

The liquefier may comprise an additional first cryogenic cold box for cooling a hydrogen feed stream at a first pressure and an additional second cryogenic cold box (20K CB) for further cooling the hydrogen so as to liquefy the hydrogen in the second additional cryogenic cold box or downstream thereof, means for providing liquefied hydrogen from the second additional cryogenic cold box or downstream thereof to the storage or the loading bay containing at least one hydrogen transport truck, an additional hydrogen refrigeration cycle used to provide refrigeration for the second cryogenic cold box, means for sending the boil-off stream warmed in the first heater to be mixed with the additional hydrogen refrigeration cycle and means for sending the boil-off stream warmed In the first heater to be mixed with a hydrogen feed stream upstream of the first additional cryogenic cold box.

This process allows also to mutualize the flexibility of all compressors and hydrogen generation system by separating the BOG depending on its pressure level in order to route it to different tie-in points with different inlet pressures to maximize the flexibility of the integrated liquefaction system and speed up the filling sequence of the hydrogen transport trucks or increase the recovery of BOG. Temperature conditions may be taken into account but preferably only when the BOG is sufficiently cold to be sent to the hydrogen refrigeration cycle without any heating step.

Hydrogen liquefaction is an expensive process and BOG recovery of vaporized hydrogen molecules is extremely valuable, especially when the gaseous hydrogen is produced at a high cost, for example by electrolysis. BOG generation generally occurs through the liquefier cold end flash, LH2 piping, LH2 storage, during the hydrogen transport truck loading process and afterwards during the delivery of the liquid hydrogen.

BRIEF DESCRIPTION OF THE DRAWINGS

The invention will be understood better from reading the following description and from studying the accompanying figures. These figures are given only by way of illustration and do not in any way limit the invention.

DETAILED DESCRIPTION OF THE INVENTION

Figure 1:
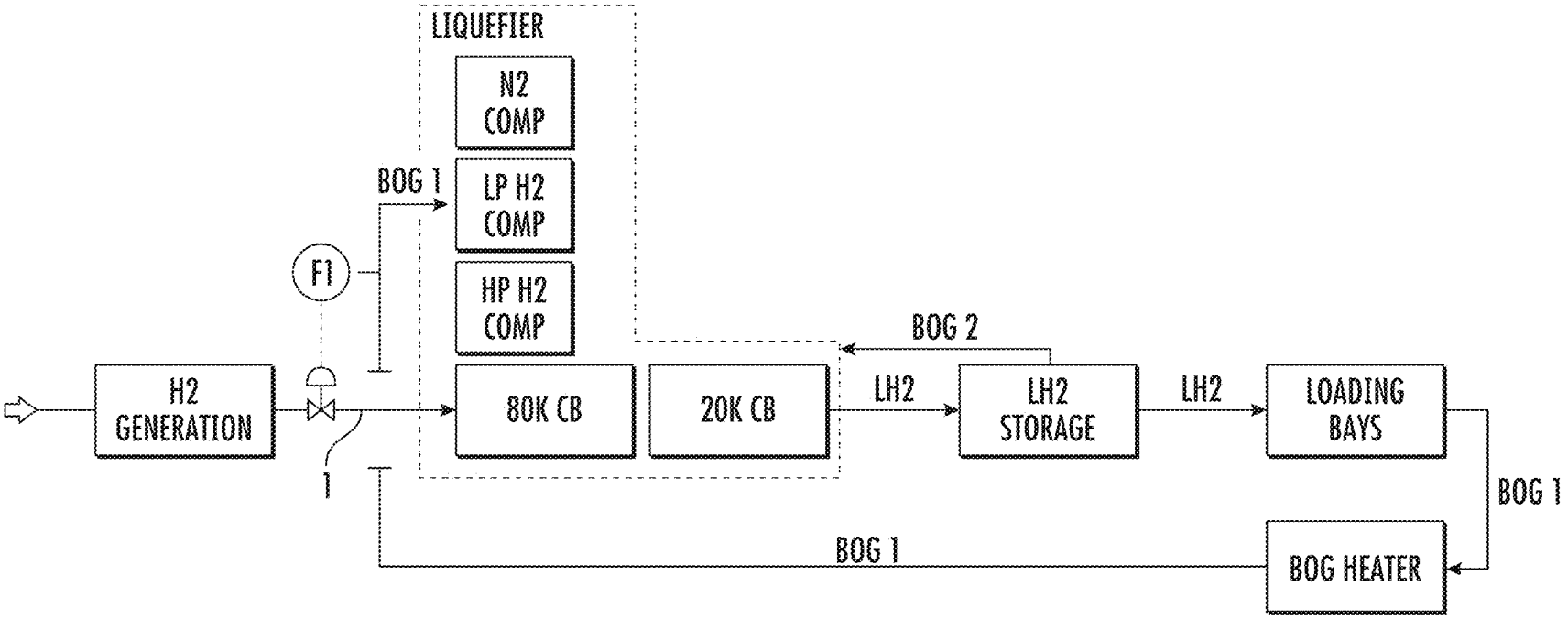
FIG. 1 illustrates a boil-off recovery process where boil-off gas is recycled to the hydrogen refrigeration cycle.

There are different ways to recover the BOG from those different areas of the plant (liquefier, storage and loading). FIG. 1 below shows a method of BOG recovery.

The hydrogen (1) can be generated by a steam methane reformer (SMR) or electrolysis or any other known means, indicated on the figure as H2 Generation. Hydrogen (1) can also come from an industrial complex off-gas or from a pipeline. Once free of any components that may freeze in the downstream cold box, it enters the liquefier.

In FIG. 1, the liquefier uses a pre-cooling cycle (typically nitrogen). The liquefier comprises a first cryogenic cold box which is an 80K Cold Box (80K CB) cooled down using a N2 refrigeration cycle with N2 compression (N2 COMP) and a second cryogenic cold box which is a 20K Cold Box (20K CB) using a separate Hydrogen liquefaction cycle. The Hydrogen refrigeration cycle uses an LP compressor (LP H2 COMP) and a HP compressor (HP H2 COMP) to compress the cycle hydrogen. Other types of refrigeration cycle may of course be used, such as mixed refrigerant cycles, using for example mixtures of nitrogen and hydrocarbons, in addition to or instead of the cycles mentioned.

Once liquefied within or downstream the 20K cold box, the liquid hydrogen is stored, typically in vacuum insulated storage bullet tank(s) LH2 STORAGE or a sphere depending on the capacity. Downstream of the storage LH2 STORAGE is the loading area LOADING BAYS which includes multiple loading bays and sometimes transfer pumps. In the loading bay, at least one truck is present, to be filled or having been filled with liquefied hydrogen. The term 'loading bay' is thus a convenient manner of referring to the at least one hydrogen transport truck present therein. FIG. 1 also shows the main BOG routings. For example, the boil-off gas BOG2 generated between the 20K Cold Box and through the storage tank LH2 STORAGE is generally recycled back into the cold end of the liquefier. Downstream the storage, at the loading bay, liquid and vapor phases from the hydrogen transport truck (or trucks) are both connected to the plant. Hence, the vapor phase BOG1 from the hydrogen transport truck is collected through the BOG network and is typically warmed up through a BOG heater by indirect heat exchange and recycled to the LP Compressor (LP H2 COMP) used to compress the refrigeration cycle hydrogen for the 20K cold box. The flow BOG1 is then mixed with the H2 cycle flow. This BOG heater typically uses an external fluid, such as steam or water to warm the BOG. Thus in this case, the gas BOG1 is warmed outside the liquefier and sent to the liquefier at the appropriate temperature to be mixed with the cycle gas.

Figure 2:
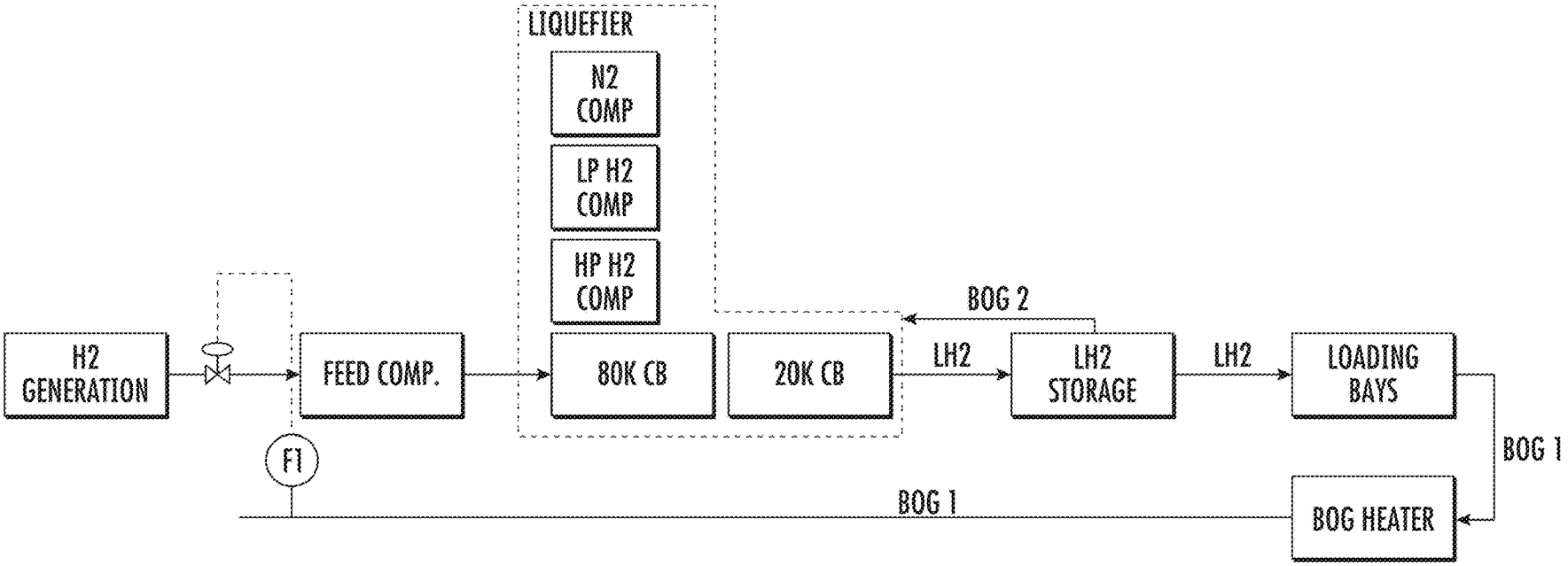
FIG. 2 illustrates a boil-off recovery process where boil-off gas is recycled to the hydrogen feed compressor.

In FIG. 2, the H2 generation takes place at relatively low pressure (for example in the case of electrolysis) and a feed gas compressor (FEED COMP) is required upstream of the liquefier to compress the hydrogen 1 generated in the hydrogen generation unit. In this case the BOG2 generated during the loading process is warmed up through the BOG heater, similar to that of FIG. 1) using an external fluid, and is recycled back into the Feed Gas Compressor (FEED COMP). The main difference with FIG. 1 is that the hydrogen transport truck boil off gas BOG2 is recycled into the feed line whereas FIG. 1 recycles the BOG into the H2 refrigeration loop.

This has the advantage of recycling the boil-off BOG1 without affecting the liquefier operation. Also, another advantage is that the BOG flow does not affect the rated flow of the Feed gas Compressor train(s) capacity since the H2 generation unit can be turned down by the same amount to ensure that the feed gas compressor FEED COMP always sees a constant flowrate. Generally, however, the Feed Gas Compressor FEED COMP may be located even farther from the loading bay from which the BOG originates than the LP compressor LP H2 COMP. The distance between the loading area and the Feed compressor may be a concern as regards the maximum allowable pressure drop as the return BOG pressure may be extremely low (1 to 2 bara).

This invention focuses on the BOG generation and recovery from the loading area. The BOG generated in the loading area presents many challenges:

The BOG amount when the hydrogen transport truck returns to the loading bay depends on the logistics chain, delivery method, distance to customers, number of customers delivered, billing method etc.

BOG generation can be diverse and includes the following:

- Hydrogen transport truck depressurization: in case of a hydrogen transport truck arriving on site at high pressure with a residue of liquid H2 stored onboard.
- Hydrogen transport truck filling. This operation will generate gaseous hydrogen return at low pressure.
- "Natural heat release" around the storage systems Valorizing all the type of BOG using the process according to FIG. 1 within the liquefier by reducing the load of the H2 generation system could lead to the following disadvantages:

- Huge overdesign of the liquefier's compression train(s) and it could be difficult to force a wide range of ramp up/ramp down on liquefier's machines
- Process upset on liquefier in order to manage this additional peak.

Managing the BOG only with the solution of FIG. 2 would also be challenging as it would lead to:

- Valorisation of BOG above a certain minimum pressure (leading to a loss BOG at low pressure resulting for instance from natural heat ingress on storages)
- Forcing a wide range of ramp up/ramp down on Feed gas compression train(s). Note that the addition of a buffer to handle this ramp/up difficulty is costly BOG recovery with such schemes is typically limited to ~70%.

It is important to note that when the BOG is recycled to the liquefier, the feed gas flowrate is reduced by the same amount. Hence, BOG recovery is even more valuable when the H2 generation comes at a high OPEX cost as in the case of electrolysis.

Figure 3A:
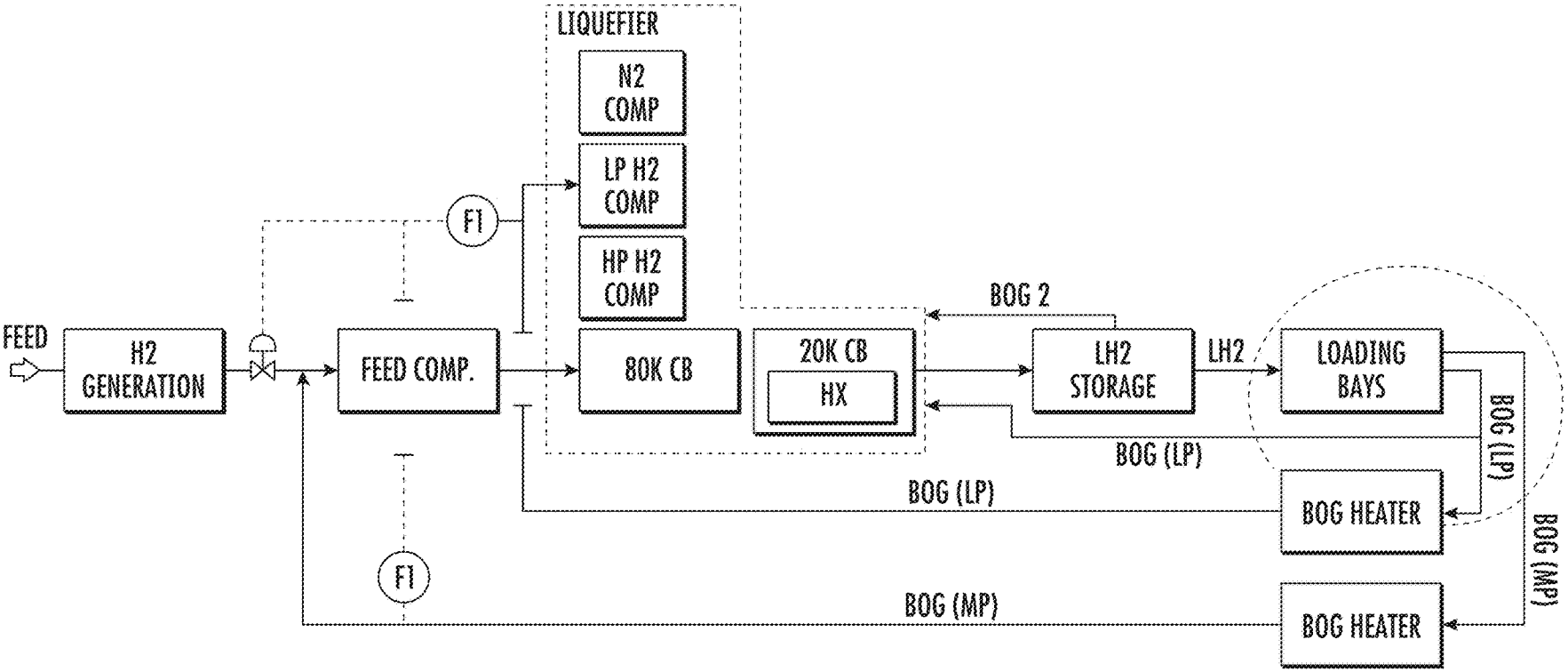
FIG. 3 illustrates a single train boil-off recovery process where boil-off gas is recycled to the hydrogen feed compressor and to the hydrogen refrigeration cycle.
Figure 3B:
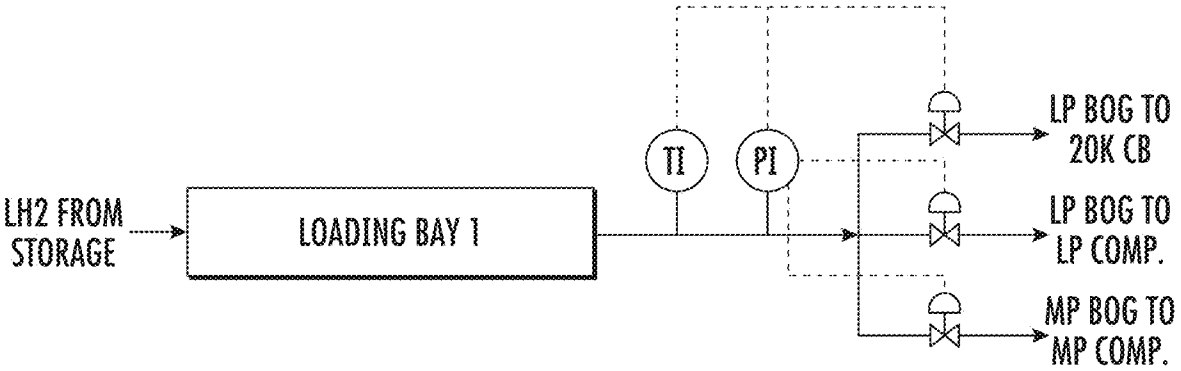

One embodiment of the proposed invention as shown in FIGS. 3A and 3B is typically applicable for liquefaction trains from about 5 to about 80 tpd. In this embodiment, three different BOG networks are created and the high pressure BOG recovery network or networks are separated from the low pressure BOG recovery networks:

- The BOG generated during the filling of the truck (at a pressure of <2 bara, for example) can generally be routed either to the warm end of the LP cycle compressor as in the case of FIG. 1.
- Since the BOG recovery pressure in that network is limited, the BOG temperature leaving the truck is better managed. Hence, it would be much easier to recover the LP BOG at the cold end of the liquefier, in a similar fashion to what is done for the storage boil off gas BOG2.
- The BOG generated during the depressurization are at a higher pressure (~2 to 10 bara) and can be routed to the feed gas compressor.
- Each BOG network can be connected to every loading bay.

Thus FIG. 3A shows that the low pressure boil-off gas BOG (LP) at below a given pressure (here 2 bars) is either heated in a first external heater BOG HEATER and sent to the inlet of a compressor of the hydrogen refrigeration cycle (if the return temperature is above a given temperature; here −200° C.) or directly routed to the liquefier cold end, without passing through the first or second heaters, to be recovered through the hydrogen refrigeration cycle and is heated in a heat exchanger HX of the first and/or second cryogenic cold box to cool the hydrogen feed stream to be liquefied (if return temperature is below a given temperature; here −200° C.) and high pressure boil-off gas BOG (MP) at above a given pressure (here 2 bars, for example between 2 and 10 bars) is heated in a second heater BOG HEATER and sent to the inlet of the feed compressor upstream of the liquefier.

As shown in FIG. 3B, the loading bay containing at least one hydrogen transport truck produces a boil-off gas whose pressure and temperature is detected using pressure detection means PI and temperature detection means TI. Whilst the pressure detector PI can open all three conduits, namely the conduit leading to the 20K cold box, the conduit connected to the LP compressor of the hydrogen refrigeration cycle and conduit connected to the MP compressor i.e. the feed hydrogen compressor, the temperature detector is only connected to the conduit leading to the 20K cold box. In other words, the decision to send the BOG either to the MP compressor or the LP compressor is taken solely based on the pressure value and is independent of the temperature. Thus any BOG with a pressure above the predetermined pressure will be sent to the feed compressor, regardless of its temperature. If the pressure is below a predetermined value, at least one inlet valve to at least one low pressure circuit is opened and the inlet valve to a high pressure circuit is closed. Thus the low pressure boil-off gas at, for example, less than 2 bars, is sent via the low pressure circuit to the low pressure heater and thence to the hydrogen refrigeration circuit. If the pressure is above a predetermined value, at least one inlet valve to at least one low pressure circuit is closed and an inlet valve to a high pressure circuit is opened. Thus the higher pressure boil-off gas at, for example, between 2 and 10 bars, is sent via the higher pressure circuit to the hydrogen feed stream, preferably being compressed in the feed compressor FEED COMP to the first pressure.

Only in the case where the temperature is below a predetermined value and the pressure is also below the predetermined value, for example if the pressure is less than 2 bars and the temperature around −200° C., the low pressure boil-off gas is routed to the 20K Cold Box.

The advantages of the process are as follows:

The operating range of the compressor LP H2 COMP of the hydrogen refrigeration cycle is much reduced and the compressor design is simplified.—The compressor LP H2 COMP can easily operate considering zero BOG returning to the liquefier but also can perform well if multiple hydrogen transport trucks are being filled simultaneously. The ramp-up and down between the running cases with or without BOG recovering is therefore reduced and the reactivity of the cycle compressor LP H2 COMP is enhanced.

The liquefier production capacity becomes independent of the hydrogen transport truck BOG recycle to the LP machine since LP BOG represent a much smaller and much more stable flow.

As mentioned above, the Feed gas compressor system design can handle the depressurization BOG by reducing the production of the upstream H2 generation unit. The BOG flow is typically much smaller compared to the nominal capacity of the feed compressor, hence the depressurization BOG flow can be increased and the depressurization time decreased. In this way, the entire loading process duration might be reduced to the point that it may be possible to consider one less loading bay for the design of the plant. The ramping up and down of the integrated system to recover depressurization BOG is therefore taking advantage of the mutualized flexibility of the hydrogen generation system as well as from the feed compressor.

BOG recovery is maximized (up to more than 90% recovery) and the sizing of the equipment is very little dependent on the BOG flowrate recycled.

It will be appreciated that the liquefaction process may be producing liquid hydrogen to be sent to a storage tank or to a hydrogen transport truck whilst BOG is recovered from the storage tank and/or the hydrogen transport truck being filled and/or another hydrogen transport truck, e.g. a truck returning to the facility after delivering liquid hydrogen but still containing BOG.

It is possible to use a purity detection for the BOG coming from the loading bay however any BOG below a predetermined purity level will be discarded upstream of the detectors TI, PI and the choice of destination for the BOG is not dependent on its purity.

Figure 4:
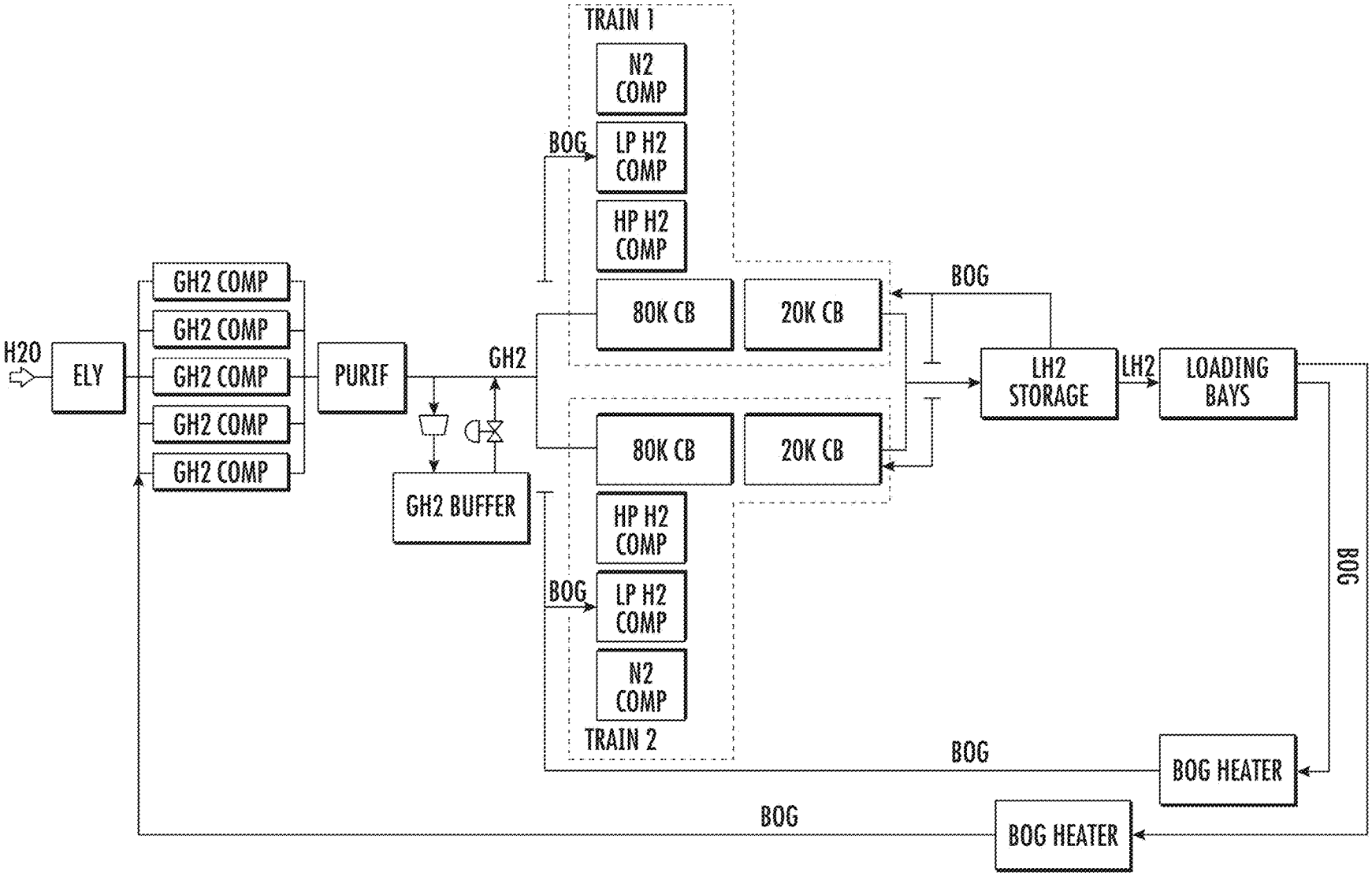
FIG. 4 illustrates a double train boil-off recovery process where boil-off gas is recycled to the hydrogen feed compressor and to the hydrogen refrigeration cycle.

FIG. 4 is similar to FIG. 3 except that it includes two liquefaction trains, each having the same elements as the liquefier of FIG. 3. Water H2O feeds an electrolysis unit ELY to produce a feed stream of hydrogen which is compressed in a plurality of parallel compressors GH2 COMP, upstream of a common purification unit PURIF to remove any impurities which might freeze in the cold box. If necessary, gaseous hydrogen may be stored in a hydrogen buffer GH2 BUFFER.

The BOG systems for both trains are connected. The benefit of the invention when there are multiple liquefaction trains is that the BOG recovery is quasi-independent of whether or not one liquefaction train is shut down. A single loading bay is fed from the two liquefaction trains.

When the loading bay containing at least one truck produces a boil-off gas whose pressure and/or temperature is detected such that if the pressure and/or the temperature is below a predetermined value, at least one inlet valve to at least one low pressure circuit is opened and an inlet valve to a high pressure circuit is closed.

Thus the low pressure boil-off gas at, for example, less than 2 bars, is sent via the low pressure circuit to the low pressure heater and thence to the hydrogen refrigeration circuits of the two liquefaction trains. If the pressure is above a predetermined value, at least one inlet valve to at least one low pressure circuit is closed and an inlet valve to a high pressure circuit is opened. Thus the higher pressure boil-off gas at, for example, between 2 and 10 bars, is sent via the higher pressure circuit to the hydrogen feed stream which feeds both liquefier trains, preferably being compressed in the five parallel compressors GH2 COMP.

Figure 5:
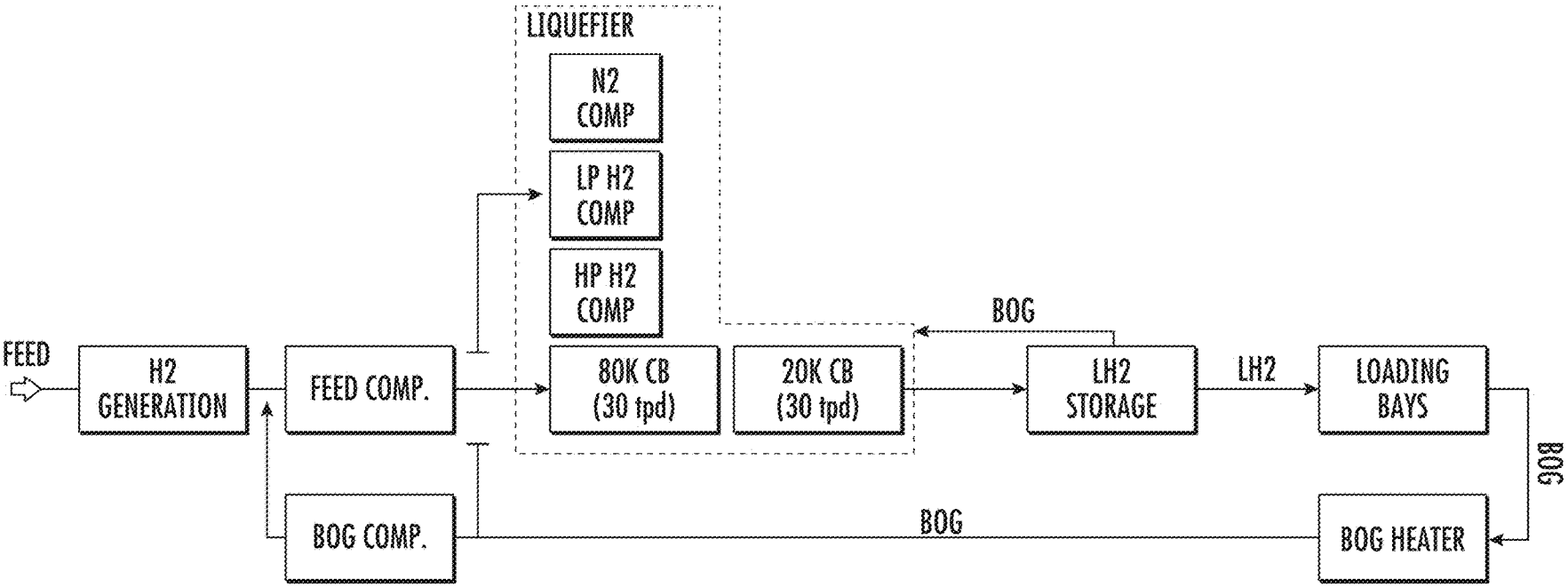
FIG. 5 illustrates a single train boil-off recovery process where boil-off gas is recycled to the hydrogen feed compressor, following an additional compression step, and to the hydrogen refrigeration cycle.

FIG. 5 is an alternative solution to FIG. 3 above. In FIG. 5, the LP and HP BOG streams are combined similarly to FIG. 1 or FIG. 2, so that there is a single boil-off gas stream heated in the boil-off heater BOG HEATER, by heat exchange with an external stream. Since the average BOG flow of a truck during an entire loading sequence is so small, and depressurization BOG peaks are more rare, it makes sense that the BOG is preferentially sent to the hydrogen refrigeration cycle, for example to the inlet of the LP compressor LP H2 COMP of the hydrogen refrigeration cycle.

In the case of peak BOG flow, for example during depressurization of a truck, a BOG compressor is added in order to recycle the extra BOG flow to the hydrogen liquefaction system feed inlet by increasing the pressure of the extra BOG flow up to the suction pressure of the feed process (typically in the above scheme, up to the suction of the feed compressor FEED COMP). For this a dedicated boil-off compressor BOG COMP is used.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A hydrogen boil-off gas recovery method, the method comprising the steps of:

cooling a hydrogen feed stream at a first pressure in a first cryogenic cold box to form a cooled hydrogen stream;

further cooling the cooled hydrogen stream in a second cryogenic cold box by using a hydrogen refrigeration cycle to refrigerate the second cryogenic cold box;

liquefying the hydrogen in the second cryogenic cold box or downstream of the second cryogenic cold box;

providing the liquefied hydrogen to a loading bay containing at least one hydrogen transport truck;

sending a boil-off gas stream from the at least one hydrogen transport truck in the loading bay to which the liquefied hydrogen has been provided to an indirect heat exchanger outside the first cryogenic cold box and the second cryogenic cold box in order to warm the boil-off gas stream, wherein the indirect heat exchanger comprises at least one of a first heater and a second heater;

measuring the pressure of the boil-off gas stream; and determining whether the pressure of the boil-off gas stream is above or below a previously determined pressure, wherein if the boil-off gas stream from the at least one hydrogen transport truck is below the previously determined pressure the method includes a step of warming at least part of the boil-off gas stream in the first heater and mixing the at least part of the boil-off gas stream with a hydrogen refrigeration cycle stream, wherein if the boil-off gas stream from the at least one hydrogen transport truck is above the previously determined pressure, the method includes a step of warming the at least part of the boil-off gas stream from the at least one hydrogen transport truck in the first heater or in the second heater and mixing said at least part of the boil-off gas stream with a hydrogen feed stream upstream of the fist cryogenic cold box.

2. The method according to claim 1, wherein if the boil-off gas stream from the at least one hydrogen transport truck is above the previously determined pressure, at least part of the boil-off gas stream from the at least one hydrogen transport truck is warmed in the second heater and mixed with the hydrogen feed stream upstream of the first cryogenic cold box, regardless of the temperature of the boil-off gas stream.

3. The method according to claim 1, wherein the at least part of the warmed boil-off gas stream is compressed in a dedicated compressor before being mixed with the hydrogen feed stream.

4. The method according to claim 1, wherein the at least part of the warmed boil-off gas stream is compressed to the first pressure after being mixed with the hydrogen feed stream.

5. The method according to claim 1, wherein the hydrogen feed stream is generated by a hydrogen generation unit and sent to the first cryogenic cold box in a first amount if the warmed boil-off gas stream is not mixed with the hydrogen feed stream and if the warmed boil-off gas stream is mixed with the hydrogen feed stream, the amount of hydrogen feed stream sent from the hydrogen generation unit to the first cryogenic cold box is reduced to a second amount, smaller than the first amount.

6. The method according to claim 1, wherein the previously determined pressure is between 1.5 and 3 bars.

7. The method according to claim 1, wherein the boil-off gas stream is analyzed to detect a value of a component of the boil-off gas stream and if a hydrogen content of the boil-off gas stream is below a predetermined value and/or if an impurity content is above a predetermined value, the boil-off gas stream is not sent to the hydrogen feed stream or the hydrogen refrigeration cycle.

8. The method according to claim 1, wherein if the boil-off gas stream from the at least one hydrogen transport truck is below the previously determined pressure and below a previously determined temperature, at least part of the boil-off gas stream is not warmed in the first heater but is mixed with a hydrogen refrigeration cycle stream.

9. The method according to claim 1, wherein the previously determined pressure has a value chosen between 2 and 10 bars.

10. The method according to claim 6, wherein if the boil-off gas stream from the at least one hydrogen transport truck is below the previously determined pressure but above a previously determined temperature, the boil-off gas stream is heated in the first heater and returned to the hydrogen refrigeration cycle.

11. The method according to claim 6, wherein if the boil-off gas stream from the at least one hydrogen transport truck is below the previously determined pressure and below a previously determined temperature, the boil-off gas stream is not heated in the first heater or the second heater and is heated in a heat exchanger of the first cryogenic cold box and/or the second cryogenic cold box to cool the hydrogen feed stream to be liquefied.

12. The method according to claim 8, wherein the previously determined temperature is between −180° C. and −210° C.

13. A hydrogen liquefier and boil-off gas recovery apparatus, the apparatus comprising:

a liquefier configured to liquefy hydrogen, the liquefier comprising: a first cryogenic cold box for cooling a hydrogen feed stream at a first pressure and a second cryogenic cold box for further cooling the hydrogen so as to liquefy the hydrogen in the second cryogenic cold box or downstream of the second cryogenic cold box;

a loading bay containing at least one hydrogen transport truck, wherein the loading bay is in fluid communication with the liquefler such that the loading bay is configured to receive liquid hydrogen from the liquefier;

a hydrogen refrigeration cycle used to provide refrigeration for the second cryogenic cold box;

means for detecting the pressure of a boil-off gas stream from the at least one hydrogen transport truck;

a first heater and a second heater outside the first cryogenic cold box and the second cryogenic cold box;

a controller comprising:

one or more processors; and memory coupled to the one or more processors, the memory storing instructions that, when executed by the one or more processors, cause the one or more processors collectively to perform operations comprising:

determining if the detected pressure is below or above a previously determined pressure;

sending the boil-off gas stream from the at least one hydrogen transport truck to the first heater if the detected pressure is below the previously determined pressure;

sending the boil-off stream warmed in the first heater to be mixed with the hydrogen refrigeration cycle and sending the boil-off gas stream from the at least one hydrogen transport truck to the second heater if the detected pressure is above the previously determined pressure; and sending the boil-off stream warmed in the first heater to be mixed with the hydrogen feed stream upstream of the first cryogenic cold box.

14. The liquefier according to claim 13, wherein the instructions stored on the memory further cause the one or more processors collectively to perform the operations comprising: detecting the temperature of the boil-off gas stream from the at least one hydrogen transport truck, sending the boil-off gas stream from the at least one hydrogen transport truck to the hydrogen refrigeration cycle without being heated if the detected temperature is below a previously determined temperature and if the detected pressure is also below the previously determined pressure.

15. The liquefier according to claim 13, further comprising:

an additional first cryogenic cold box configured to cool the hydrogen feed stream at the first pressure and an additional second cryogenic cold box configured to further cool the hydrogen so as to liquefy the hydrogen in the additional second cryogenic cold box or downstream of the additional second cryogenic cold box, wherein the loading bay is im fluid communication with the additional second cryogenic cold box such that the additional second cryogenic cold box is configured to receive liquefied hydrogen;

an additional hydrogen refrigeration cycle used to provide refrigeration for the additional second cryogenic cold box, wherein the additional hydrogen refrigeration cycle is in fluid communication with the first heater such that the additional hydrogen refrigeration cycle is configured to receive the boil-off gas stream warmed in the first heater.

* * * * *